US006572942B2

(12) United States Patent
Wurr et al.

(10) Patent No.: US 6,572,942 B2
(45) Date of Patent: Jun. 3, 2003

(54) STATIC DISSIPATIVE FABRIC FOR FLEXIBLE CONTAINERS FOR BULK MATERIAL

(75) Inventors: Egon Wurr, Rheine (DE); Siegfried Hartmann, Ibbenbueren (DE); Bruce A. Boyd, Spring, TX (US); Stephan Grewe, Rheine (DE); Andreas Grewe, Rheine (DE)

(73) Assignee: Eurea Verpackungs GmbH & CO. KG, Rheine (DE)

( * ) Notice: Subject to any disclaimer, the term of this patent is extended or adjusted under 35 U.S.C. 154(b) by 0 days.

(21) Appl. No.: 09/854,394

(22) Filed: May 11, 2001

(65) Prior Publication Data

US 2002/0039631 A1 Apr. 4, 2002

(51) Int. Cl.[7] ..... B65D 30/04

(52) U.S. Cl. ..... 428/36.1; 383/24; 383/109; 383/113; 383/116; 383/117; 139/1 R; 442/110; 428/368; 428/374; 428/397

(58) Field of Search ..... 383/24, 109, 113, 383/116, 117; 139/1 R; 442/110; 428/36.1, 368, 374, 397

(56) References Cited

U.S. PATENT DOCUMENTS

| | | | | |
|---|---|---|---|---|
| 5,478,154 A | * | 12/1995 | Pappas et al. | 383/117 |
| 5,679,449 A | | 10/1997 | Ebadat et al. | 428/288 |
| 6,112,772 A | | 9/2000 | Ebadat et al. | 139/1 R |

FOREIGN PATENT DOCUMENTS

| | | | |
|---|---|---|---|
| GB | 2101559 | | 1/1983 |
| GB | 2 101 559 A | * | 1/1983 |
| WO | WO9609629 | | 3/1996 |

* cited by examiner

*Primary Examiner*—Harold Pyon
*Assistant Examiner*—Brian P Egan
(74) *Attorney, Agent, or Firm*—Milde & Hoffberg, LLP

(57) ABSTRACT

Antistatic fabric for flexible containers for bulk material that includes electrically non-conducting threads and static dissipative, special permanent antistatic threads. The static dissipative, special permanent antistatic threads are made of a thermoplastic synthetic with an additive mixed in that increases the conductivity. The static dissipative, special permanent antistatic thread is shaped like a small band or tape with an approximately rectangular cross-section or a multifilament of very thin filaments.

21 Claims, 4 Drawing Sheets

STATIC DISSIPATIVE FABRIC FOR FLEXIBLE CONTAINERS FOR BULK MATERIAL

BACKGROUND OF THE INVENTION

The invention relates to a static dissipative fabric for flexible containers for bulk material.

When in use, a separation of charge occurs on fabrics made of non-polar synthetics, especially due to friction, such that electrostatic charges collect on the surface of the fabric and increases static charge in a finite area if they cannot dissipate via the air due to a dry environment with low air humidity. Upon contact with grounded objects and/or persons, these charges can suddenly discharge, whereby a high-energy spark can flash across that may be capable of igniting a dust/air mixture or a gas/air mixture and of triggering an explosion.

In addition, there is the risk of charge accumulation due to electrostatic induction. With this physical phenomenon, an electrical field can be formed between two bodies, where a non-contact charge transfer occurs. Thus, electrical charges that are generated when filling a container made of a synthetic fabric can be transferred to adjacent bodies with greater capacities, e.g., non-grounded metal barrels on wood pallets. In this manner, an explosion hazard may exist even in the surrounding area of a container made of synthetic fabric, because of spark generation.

The German Patent No. DE 39 38 414 C2 of the applicant discloses a container for bulk material made of an electrically conducting fabric that consists of synthetic fibers or synthetic threads and that includes electrically non-conducting as well as electrically conducting threads, where the electrically conducting threads are made of a polyolefin and contain dispersed carbon black and/or graphite and that are woven into both warp and weft.

A fabric of such kind is well suited for the strong mechanical strain that occurs when using the fabric for a flexible container As, for bulk material, and a carrier to dissipate the electrostatic charge is ensured through the electrically conducting threads woven into the fabric.

A fabric considered "electrically conducting" exhibits a dissipation resistance to ground of less than $10^8$ Ω. Such a dissipation resistance is generally required for explosion protection measures based on various technical safety regulations, and also for flexible containers for bulk material made of Type "C" polypropylene fabric according to the classification of the German industrial research group "Brennbare Stäube/Elektrostatik". This classification has become accepted worldwide.

However, it has been observed that paradoxically such a low dissipation resistance of the fabric entails an adverse effect: due to its low resistance, charges can move rapidly and with a high charge density across the entire surface of the fabric and can suddenly discharge at a point where contact occurs with a charge carrier of an opposite charge for example, a grounded person. Thus, a ground connection always needs to be established prior to the filling procedures that could cause a charge separation, to ensure that if a charge comes into existence it can flow from the fabric immediately to ground.

However, this ground connection has proven to be an impediment, because, for example, prior to filling, a container for bulk material has to be individually and manually grounded using a metal clip and a metal cable, and thereafter, the ground connection has to be manually removed. Furthermore, there is the risk of forgetting to make the ground connection due to carelessness.

Known from the British Patent No. GB 21 01 559 A1 is a container for bulk material that is manufactured of a fabric that has metal threads woven into it, where said threads are capable of discharging the electrostatic charge of the fabric.

The disadvantage of this solution is that the stretching behavior of metal fibers or threads deviates significantly from that of the remaining fabric. This can easily lead to breakage of the metal fibers and thus to an interruption in the discharge.

An additional risk is that the metal threads that are made of, e.g., copper, or iron, or alloys thereof, corrode in air. Due to such interruption points, the risk of a spark generation and explosion is increased significantly in case of a static charge.

Also known are fabrics that have an antistatic agent applied, such that the finished prefabricated fabric can discharge electrical charges.

However, a fabric manufactured in this manner only meets the requirements with regard to fire and explosion hazards in its new condition. The state of the art static dissipative coating, which is capable of discharging Charges, is not durable and has a limited useful life. Equipping a container with an applied static dissipative coating has proven unsuitable in such applications, where the fabric is subject to strong mechanical abrasion. Bulk material containers are subjected to mechanical abrasion in handling, truck loading or unloading, transit and/or stacking. This great expansion of the highly loaded synthetic fabric can cause the coating to tear or separate from the fabric. Such containers are used repeatedly in multiple trip applications. A particular risk exists, when the loss of electrical conductivity caused by the abrasion is not recognized during the container's multiple trip use and the user assumes protective conditions when they no longer exist.

Known from the U.S. Pat. No. 5,679,449 and the U.S. Pat. No. 6,112,772 are flexible containers for bulk material, so-called flexible intermediate bulk containers (FIBC), that are made of a material that contains conductible threads that are metallized. In the issued U.S. patents, the effect of the so-called corona discharge is described. Corona discharge occurs on the very small curvature radius of the woven, metallized carrier threads or tips. The corona discharge is a very weak discharge to the air that is limited to the immediate surroundings of the tips and occurs continuously over a long period such that manual grounding via a grounding cable is not required.

However, the conductivity of the fabric is still large enough that a quick transportation of the charge and a related sudden discharge with spark generation can occur upon contact with a large downward sinking charge.

Another disadvantage is that the static dissipative, conductible threads in the known fabric are difficult to manufacture and fabricate. Even the application of a metallic surface on a core made of synthetic polymers is involved and expensive. The antistatic sheathing is subject to mechanical wear as has been described above for the full-surface coating.

Additionally, the antistatic thread has a cross-sectional geometric design that deviates from the typical fabric weave used for containers for bulk materials and therefore causes problems with regard to process ability.

For reasons of process ability and mechanical toughness, the diameter of the coated thread cannot be kept as small as would be desirable for utilizing the corona discharge effect over the entire length of the thread and not only at its ends. Thus, localized charge fields that cannot dissipate through the corona discharge but dissipate suddenly can still occur on the surface of the fabric under unfavorable conditions.

Known from the International Patent Publication No. WO 96/09629 is an antistatic additive for thermoplastic synthetics, where said additive consists of a thermoplastic polymer mass that contains an electrically conductible web of non-metallic, microcrystalline pins. This web can be fused such that it can be produced using methods that are common in the synthetics industry and crystallizes out when the synthetics melt cools down. The microcrystalline web is embedded in the polymer mass, and is thus, wear resistant, because it cannot be removed from the surface of a component by abrasion. Furthermore, the embedding of the microcrystalline web in the thermoplastic polymer mass will not separate, migrate or dilute from the originally processed properties and/or state.

SUMMARY OF THE INVENTION

It is the objective of the invention to develop a fabric of the type mentioned above that exhibits permanent static dissipative properties and that can, therefore, be used in explosion and fire hazard zones and that especially does not need to be grounded in all applications.

According to the invention, this objective is achieved with a static dissipative fabric for flexible containers for bulk materials, where said fabric includes electrically non-conducting and static dissipative, called antistatic threads, where the antistatic threads are made of a thermoplastic synthetic with a special permanent antistatic additive mixed in that reduces the electrostatic resistivity, and where the static dissipative thread is designed either in the shape of small band called tape with an almost rectangular cross-section or as a thin thread with a substantially round cross-section.

Here, the term "antistatic" refers to a fabric whose static discharge resistance of the surface according to German Standard (Deutsche Industrie Norm) DIN 53482 is greater than $10^8$ Ω and less than $10^{11}$ Ω. With such a resistance, the flow of electrons is strongly inhibited and controlled yet still possible.

The term"small bands" refers to small synthetic bands that can be produced from extruded tape, multi filament yarn, monofilament and/or cut from foil, that have in their cross-section a greater width in relation to their thickness and that can be converted to fabrics through weaving.

Mixing the conducting additives into the polymer mass of the threads accomplishes on the one hand that the electron conduction within the thread is enabled, and on the other hand that the specific electrical resistance of the resultant thermoplastic mixture is so great that the electron flow is possible only at a very slow and controlled rate. This ensures that a continuous electron flow and a constant dissipation of the charge to the surrounding area is possible within a short period of time so that not enough charge can be stored in the bulk container that could lead to a sudden high-energy discharge generating an igniting spark.

Very narrow, sharp edges are present due to the geometry of the permanent antistatic band-shaped thread. Along the entire length of the small tape, a corona discharge can occur at the edges enabling a continuous and controlled dissipation of the charge from the surface of the fabric to the surrounding area. In addition to the advantage of the corona discharge at the narrow edges, another advantage exists due to the relatively wide small tape resulting in a large surface that exhibits a capacity to take up electrical charges. The charges are distributed across the large surface of the fabric, thus avoiding local charge concentrations that could lead to sudden high-energy discharge.

To avoid the creation of "islands" or small areas of electro statically insulating fabric sections amidst the grid of electrically conducting threads, the distance of one thread to the next is not less than 1 cm and not greater than 5 cm. Preferably, a distance of 3 cm is selected.

It is advantageous that the fabric includes a special permanent antistatic synthetic coating covering the warp threads, the weft Hi threads and the static dissipative, permanent antistatic threads, where said coating is made of a thermoplastic synthetic with an additive mixed in that increases the conductivity. This coating results in a large-area distribution of the charge across the fabric surface and thus in dissipating local charge peaks.

For the reasons mentioned above, one can in most applications avoid using manually connected grounding clips and cables when filling, handling, or discharging a flexible container for bulk material. A flexible container for bulk materials consists of a flexible carrying bag with attached carrying devices, where at least the carrying bag is made of fabric with static dissipative properties subject to the invention, so that a contact-free dissipation of the electrical charge to the surrounding area is made possible.

Especially with a flexible container for bulk material of the kind mentioned above, where at least the carrying bag is made of the static dissipative fabric subject to the invention and where a permanent antistatic synthetic coating is applied on the surface of the fabric, it is advantageous that the ability to establish manual grounding remains. For this purpose, a grounding clip only needs to be attached to a fold of the fabric. In this case, the antistatic coating not only ensures a good charge distribution across the entire surface but also that the ground clip is electrically connected with the static dissipative threads in the warp and/or weft.

Additional advantageous designs become apparent from the sub-claims and the following description of an exemplary embodiment.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
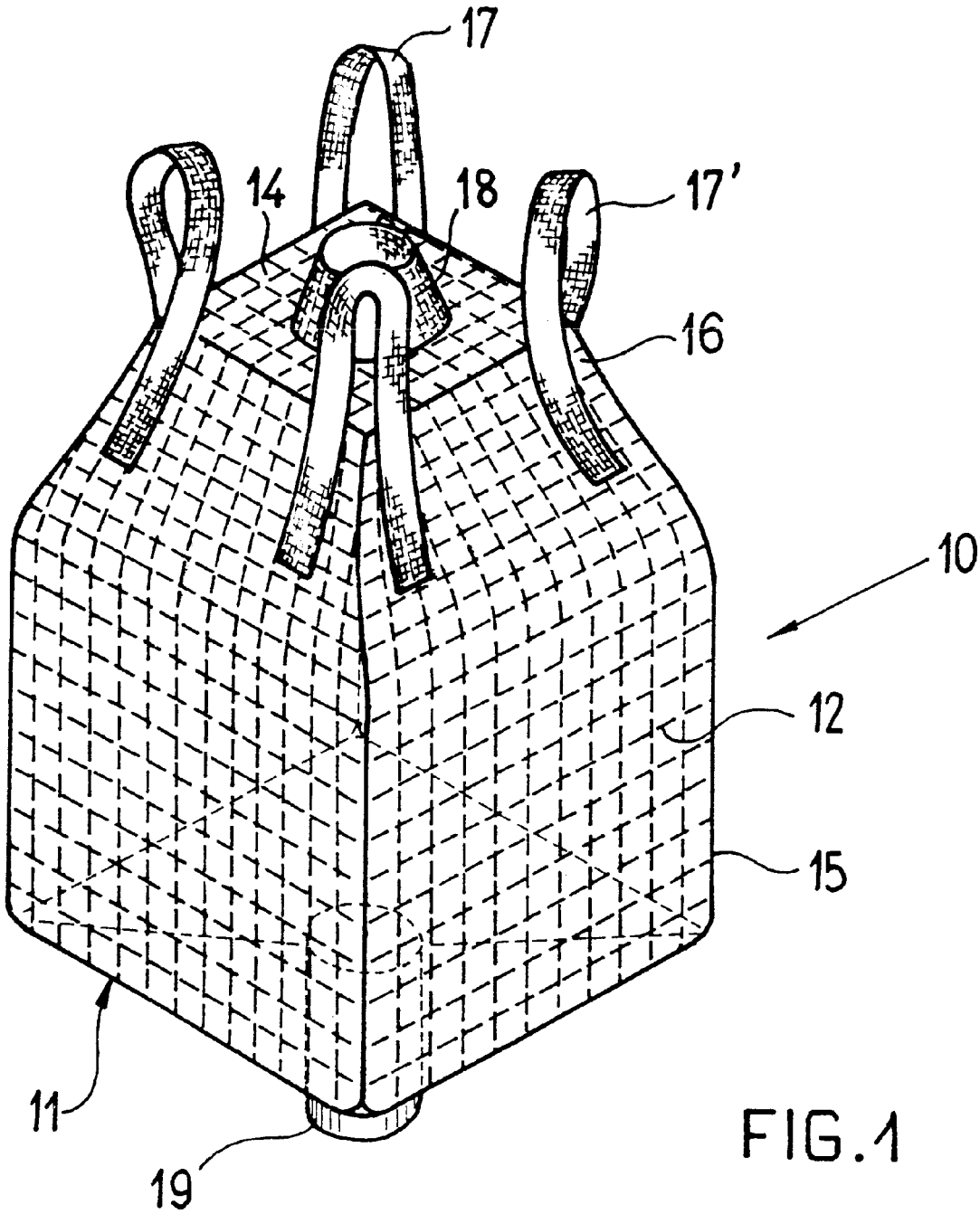
FIG. 1 shows a perspective view of a container for bulk material made of the fabric subject to the invention.

The preferred embodiments of the present invention will now be described with reference to FIGS. 1–4 of the drawings. Identical elements in the various figures are designated with the same reference numerals.

Figure 2:
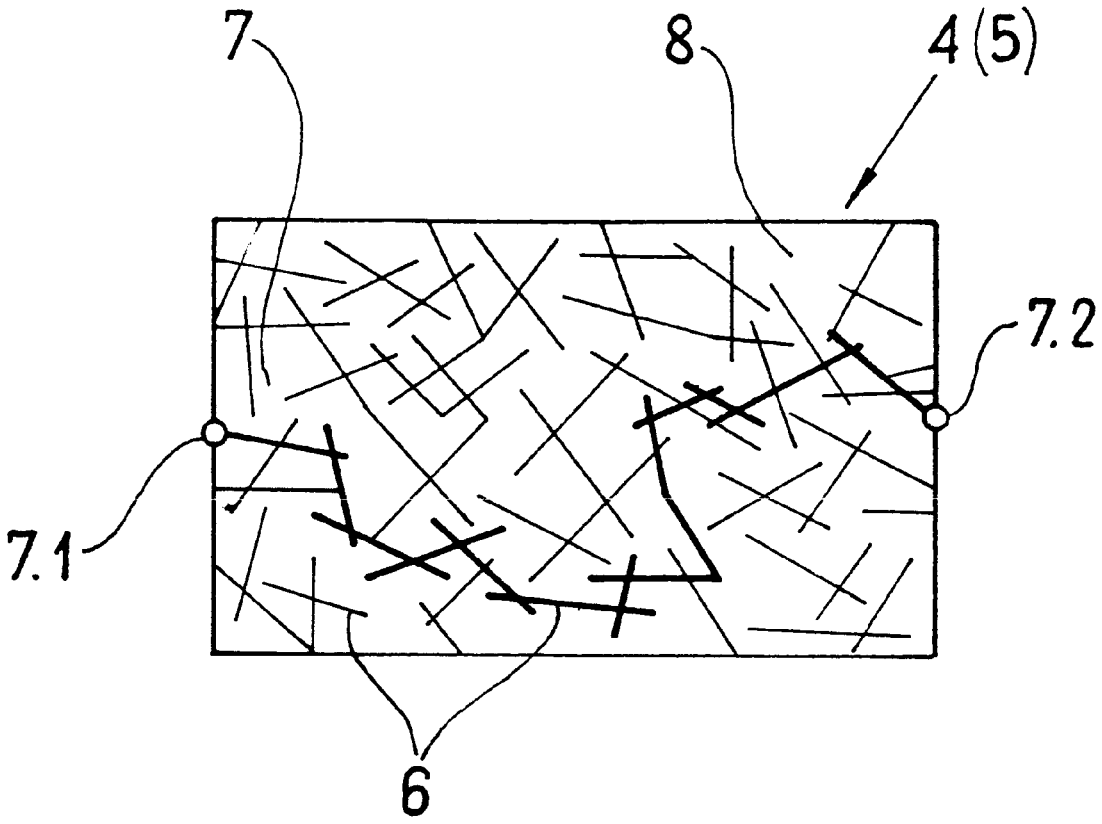
FIG. 2 shows a greatly magnified overhead view of a section of the surface of a static dissipative, special permanent antistatic.

FIG. 1 shows a flexible container 10 for bulk material made of the fabric 100, where said container 10 consists of a carrying bag 15 with a carrying belt designed as transport loops 17, 17'. In its lid section 14, the carrying bag 15 includes a filler spout 18 and in its bottom section 11 an outlet spout 19. The carrying bag 15 is made of the antistatic fabric 100 subject to the invention. In the collar section 16, in the lid section 14 as well as in the area of the filler spout 18 and the outlet spout 19, a more dense grid 12 of the static dissipative, permanent antistatic threads can be provided to optimize the discharge behavior. Conduction material is also integrated in the material for the carrying loops 17, 17' to ensure the discharge, FIG. 2 is a schematic view of a static dissipative, special permanent antistatic warp thread 4 or weft thread 5 as it can be seen under a microscope. With this advantageous embodiment, 20 percent in mass of an additive as described in WO 96/09629 is mixed into a base polymer, here polypropylene.

Numerous microcrystalline pins 6 are embedded in a matrix 8 of the base polymer, where said pins 6 are meltable and crystallize upon cooling. In this manner, the mixture can be extruded, injected or processed using another synthetics processing method.

The pins 6 are arranged in the matrix 8 with such a density that they are in contact with one another or that they overlap. Thus, using the example of the section presented here, numerous current paths 7 are formed by the microcrystalline pins 6 between a random point 7.1 and another point 7.2 at the other end of the thread section, where one such path is shown as an example as a thick drawn line. An inhibited charge transport is possible along such a current path 7.

The density of the microcrystalline pins 6, and therefore the number of generated current paths 7, is adjusted by metering the mass portion of the additive between 5% and 30% versus the polypropylene matrix, which in turn influences the overall electrostatic resistivity of the polymer mixture. Furthermore, it can be provided that in addition to the additive, pin-shaped metal particles of macroscopic dimensions that are of about 0.1 to 2 mm in length are embedded in the matrix 8. These metal particles protrude in the shape of fine tips from the surface of the static dissipative threads; a corona spray discharge can occur at these tips.

Figure 3:
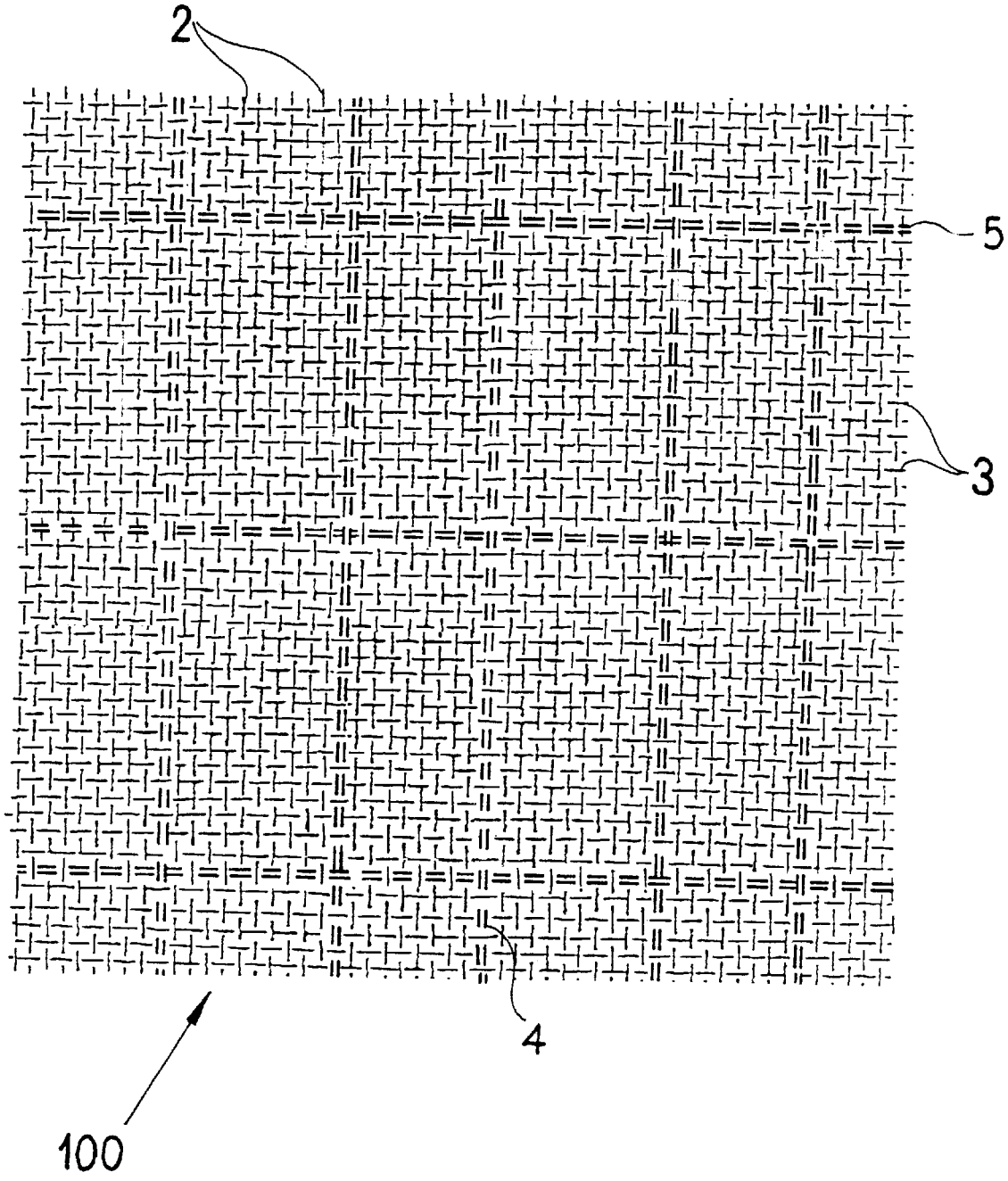
FIG. 3 shows an overhead view of a fabric subject to the invention.

FIG. 3 shows a section of a fabric 100 made according to the invention. Both warp threads 3 and weft threads 4 are small bands) tapes made of a thermoplastic synthetic. Such small tapes are easily obtained in that a synthetic foil is made that is then cut into small tapes with a knife in the direction of the web; the bands are then stretched. Because standard synthetics, especially polypropylene, are suitable and the small bands are relatively wide about 0.5 to 5 mm, when compared to textile threads, large-area fabrics can be made cost-effectively. Woven into the fabric 100 are static dissipative, special permanent antistatic threads 4 that are drawn schematically as thick double-lines for a clearer presentation.

Preferably, the static dissipative, special permanent antistatic threads 4 are woven into the warp at a distance of 3 cm to one another. To ensure a dissipation of the electrical charge, especially in case of breakage of the static dissipative, special permanent antistatic threads 5 can also be woven into the weft at greater distances, preferably of 30 cm. In case of an interruption of a antistatic warp thread 4, a bypass of the electrical charge flow to the next intact warp thread 4 can be accomplished via these weft thread 5.

Whether the static dissipative, special permanent antistatic threads 4 are mainly woven as weft threads or as warp threads has no influence on the electrical properties of the fabric subject to the invention, and can be selected according to the Am requirements of the weaver.

Because the geometry of the non-conducting threads 2, 3 and of the static dissipative, special permanent antistatic threads 4, 5 is preferably the same, there are no difficulties in weaving if the static dissipative, special permanent antistatic threads are woven in the weft.

However, round threads with mixed-in special permanent antistatic additives can be used as well if they are very thin and thus provide the possibility of a good corona discharge. Round threads can be grouped as so-called multifilaments to form a larger thread.

Figure 4:
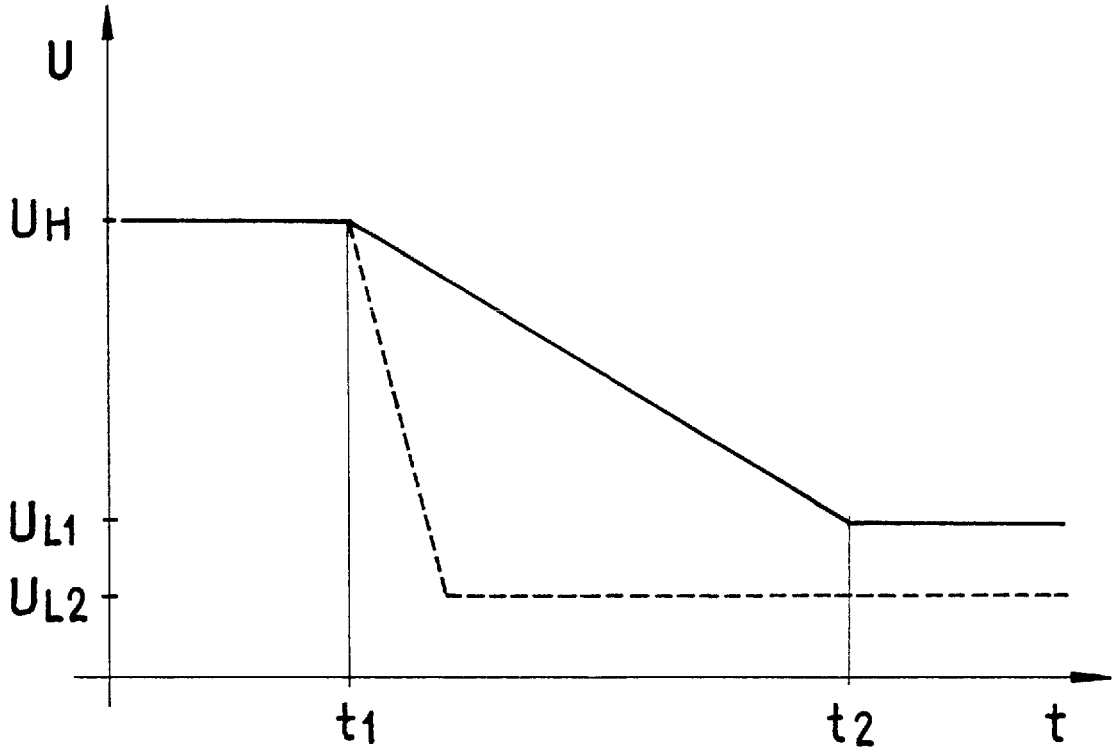
FIG. 4 shows a schematic discharge plot for the fabric subject to the invention.

FIG. 4 shows the discharge of the fabric. The voltage drop is plotted over time. Starting with a high potential UH, the charge supply is interrupted at the time t1. As the solid top line shows, the charge dissipates continuously through continuous corona discharges at the edges of the small bands, the ends of the threads, and eventually at the macroscopic metal tips that may have been mixed in, until it reaches a minimum at a level of UL1 at the time t2. The fabric was not grounded in the FIG. 4 example.

If the same fabric is grounded using a grounding cable, the charge dissipates faster and to an even lower level UL2—as indicated by the broken line; however, the levels of both remaining potentials UL1 and UL2 are low enough, such that no igniting spark occurs through contact with a person or a metallic object, etc.

There has thus been shown and described a novel static dissipative fabric for flexible containers for bulk material which fulfills all the object and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A flexible container for bulk material, consisting of a flexible carrying bag and attached carrying devices, wherein at least the carrying bag is made of an antistatic fabric that includes electrically non-conducting warp and weft threads and static dissipative, antistatic threads, wherein the antistatic threads are made of a thermoplastic synthetic with an additive mixed in that reduces electrostatic resistivity, said additive comprising a thermoplastic, heat-hardened or webbed polymer that is penetrated by an antistatic web of microcrystalline pins, whereby the antistatic threads are arrangeable in the fabric in both an intersecting and non-intersecting manner, whereby the carrying bag is both groundable and ungroundable, and whereby an antistatic coating is optionally coated to the fabric.

2. A flexible container for bulk material as set forth in claim 1, wherein the additive is mixed into the thermoplastic synthetic of the antistatic threads at a mass portion of 5% to 30%.

3. A flexible container for bulk material as set forth in claim 1, wherein in addition to the additive, pin-shaped metal particles are embedded in the thermoplastic synthetic of the antistatic threads, said metal particles being substantially isolated from each other, thereby to provide points for corona discharge.

4. A flexible container for bulk material as set forth in claim 1, wherein the thread in the shape of a small band/tape exhibits a thickness of 100 to 500 $\mu$m and a width that is 10 to 100 times the thickness.

5. Flexible container for bulk material as set forth in claim 1, wherein the antistatic fabric of the container for bulk material exhibits an increased number of antistatic threads in a lid section and a collar section of the container as compared to the remaining fabric of the carrying bag.

6. A flexible container for bulk material as set forth in claim 1, wherein the antistatic threads have a substantially rectangular cross-section.

7. A flexible container for bulk material as set forth in claim 1, wherein some of the antistatic threads are arranged in parallel and other ones of said antistatic threads are arranged at an angle with respect to the parallel antistatic threads, thereby crossing the parallel antistatic threads.

8. A flexible container for bulk material as set forth in claim 7, wherein said angle is 90°.

9. A flexible container for bulk material as set forth in claim 7, wherein said other ones of said antistatic threads interconnect said parallel antistatic threads.

10. A flexible container for bulk material as set forth in claim 1, wherein the fabric includes an antistatic synthetic coating covering warp threads, weft threads and the antistatic threads, wherein said coating is made of a thermoplastic synthetic with an antistatic additive mixed in that reduces the electrostatic resistivity.

11. Flexible container for bulk material as set forth in claim 10, wherein the antistatic synthetic coating is applied to a surface of the antistatic fabric of the carrying bag.

12. A flexible container for bulk material as set forth in claim 11, wherein the antistatic synthetic coating is applied to an outside surface of the carrying bag.

13. A flexible container for bulk material as set forth in claim 1, wherein the antistatic threads have a substantially round cross-section.

14. A flexible container for bulk material as set forth in claim 13, wherein the antistatic threads are very thin and thus provide the possibility of a good corona discharge.

15. A flexible container for bulk material as set forth in claim 14, wherein the antistatic threads are formed as a multifilament comprising a plurality of said very thin, substantially round thread filaments.

16. A flexible container for bulk material as set forth in claim 1, wherein the antistatic threads extend in the same direction as at least one of the warp and weft threads.

17. A flexible container for bulk material as set forth in claim 16, wherein the distance between the antistatic threads in the direction of a weft is 10 to 60 cm.

18. A flexible container for bulk material as set forth in claim 17, wherein said distance is approximately 30 cm.

19. A flexible container for bulk material as set forth in claim 16, wherein the distance between the antistatic threads in the direction of a warp is 1 to 5 cm.

20. A flexible container for bulk material as set forth in claim 19, wherein said distance is approximately 3 cm.

21. A flexible container for bulk material as set forth in claim 19, wherein the distance between the antistatic threads in the direction of the weft is 1 to 5 cm.

* * * * *